US005778501A

United States Patent [19]

You

[11] Patent Number: 5,778,501

[45] Date of Patent: Jul. 14, 1998

[54] WATER-JET MACHINE FOR MAUFACTURING NON-WOVEN FABRIC

[75] Inventor: Fu Kuo You, Taoyuan, Taiwan

[73] Assignee: Yu-Hau Machinery Co., Ltd., Taoyuan Hsien, Taiwan

[21] Appl. No.: 865,250

[22] Filed: May 29, 1997

[51] Int. Cl.[6] ..... D06B 5/02; D04H 1/46

[52] U.S. Cl. ..... 28/104; 28/105; 28/167; 239/553.5

[58] Field of Search ..... 28/104, 105, 167; 68/205 R, 62; 239/553.3, 553.5, 590.3, 590.5, 600

[56] References Cited

U.S. PATENT DOCUMENTS

| | | | |
|---|---|---|---|
| 3,333,315 | 8/1967 | Dyer et al. | 28/104 |
| 3,353,225 | 11/1967 | Dodson, Jr. et al. | 28/104 |
| 3,403,862 | 10/1968 | Dworjanyn | 28/104 |
| 3,613,999 | 10/1971 | Bentley | 28/104 |
| 4,069,563 | 1/1978 | Contractor et al. | 28/104 |
| 4,085,485 | 4/1978 | Brandon et al. | 28/104 |
| 5,042,722 | 8/1991 | Randall, Jr. et al. | 239/553.5 |
| 5,491,857 | 2/1996 | Love, III et al. | 68/205 R |
| 5,692,278 | 12/1997 | Fleissner | 28/105 |

*Primary Examiner*—Amy B. Vanatta

[57] ABSTRACT

A water-jet machine includes a body having a passage defined therethrough and a plurality of piston devices disposed in a top thereof, a plurality of first holes defined through a lower portion of the body, a bar disposed in an underside of the body and having a plurality of fourth holes defined therethrough, two supporting plates disposed to an underside of the bar and having a gap defined longitudinally therebetween, a board disposed between the bar and the two supporting plates and having a plurality of apertures defined therethrough which communicate with the fourth holes, the first holes and the gap, and at least one transverse bar connected to the piston devices and connected to the two supporting plates by bolts extending through the body so that the board is securely positioned by actuating the piston devices to lift the transverse bar upwardly.

5 Claims, 5 Drawing Sheets

WATER-JET MACHINE FOR MAUFACTURING NON-WOVEN FABRIC

BACKGROUND OF THE INVENTION

1. Field of the Invention

The present invention relates to a water-jet machine and, more particularly, to an improved structure of a water-jet machine for manufacturing non-woven fabric and which requires only an easy maintenance.

2. Brief Description of the Prior Art

FIGS. 1 and 2 show a general flow chart for manufacturing non-woven fabric by a water-jet machine wherein cotton sheets are delivered from a feeding machine 10 to a carding engine 20 and are immersed into a water tank 30 to let fiber of the cotton sheets become closer. The immersed cotton sheets are then delivered to a first water-jet machine 30, a second water-jet machine 31 and the third water-jet machine 32 to combine these cotton sheets into a plate of non-woven fabric which is then delivered into a hydro-extractor 40 to extract water and moisture therefrom and sent into a printing machine 50. The conventional water-jet machine 30 is shown in FIG. 3 and includes a casing 31 with a top and two sides, a plate 32 received between the two sides and a tube 33 fixedly disposed on the plate 32, an actuating means 34 disposed on the tube 33 and at least two piston means 341 actuated by the actuating means 34, at least four posts 35 disposed beside the tube 33 and each pair of the four posts 35 having an upper end fixedly connected to a transverse bar 35 and a lower end extending through the plate 32 and fixedly connected to a low plate 37, and a board 38 received between the plate 32 and the low plate 37 so that when the two piston means 341 are lifted, the transverse bars 36, the four posts 35 and the low plate 37 are lifted to securely position the board 38 between the plate 32 and the low plate 37.

The low plate 37 has a slot 370 defined therethrough. The tube 33 has a plurality of holes 330 defined through a periphery thereof and the plate 32 has the same numbers of passages 320 defined therethrough in alignment with the holes 330. The board 38 has a plurality of apertures 380 defined therethrough which communicate with the passages 320 and the slot 370 so that water flows through the tube 33 and ejects from the apertures 320 to the cotton sheet 40 passing below the slot 370 of the low plate 37. It is found that it takes a lot time to change seals 39, 391 which are respectively disposed between the tube 33 and the plate 32, the plate 32 and the board 38. That is because the posts 35, the transverse bars 36 and the low plate 37 have to be dismantled respectively, generally, there have more than four posts equipped in the above-mentioned water-jet machine. Furthermore, the tube 33, the plate 32, the board 38 and the low plate 37 have to be arranged precisely so that the holes 330 and the passages 320 are in alignment with each other.

The present invention intends to provide an improved water-jet machine for manufacturing non-woven fabric and which mitigates and/or obviates the above.-mentioned problems.

SUMMARY OF THE INVENTION

The present invention provides a water-jet machine and comprises a body having a plurality of piston means retractably received in a top thereof and a passage defined longitudinally therethrough, a groove defined longitudinally in an underside of the body and a plurality of first holes defined through an underside of the body so that the passage communicates with the groove via the first holes. The top of the body has two rows of second holes defined perpendicularly through the body and the two rows of second holes are arranged such that the ridge is located therebetween. At least two first threaded holes are defined in one of two ends of the body and the groove is located between the two first threaded holes.

Two supporting plates each have a plurality of third holes defined perpendicularly therethrough and a recess is defined along one of two sides thereof. The two supporting plates are disposed on the underside by extending bolts through the third holes, the second holes and fixedly connected to at least one transverse bar which is mounted across over the ridge. A gap is defined between the two adjacent sides having the respective recess of the supporting plates and the transverse bar is lifted by the piston means to let the supporting plates securely connect to the underside of the body.

A bar has a plurality of fourth holes defined perpendicularly therethrough and an end plate fixedly connected to one of two ends of the bar so that the bar is received in the groove by extending bolts through the end bar and engaged with the first threaded holes.

A board has a plurality of apertures defined therethrough and disposed to an underside of the bar wherein the first holes, the fourth holes and the apertures communicate with each other and are in alignment with the gap. A lower portion of the bar and the board are securely received between the two recesses of the two supporting plates when the transverse bar is lifted by the piston means.

It is an object of the present invention to provide a water-jet machine which has a simple structure.

It is another object of the present invention to provide a water-jet machine which needs only an easy maintenance.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
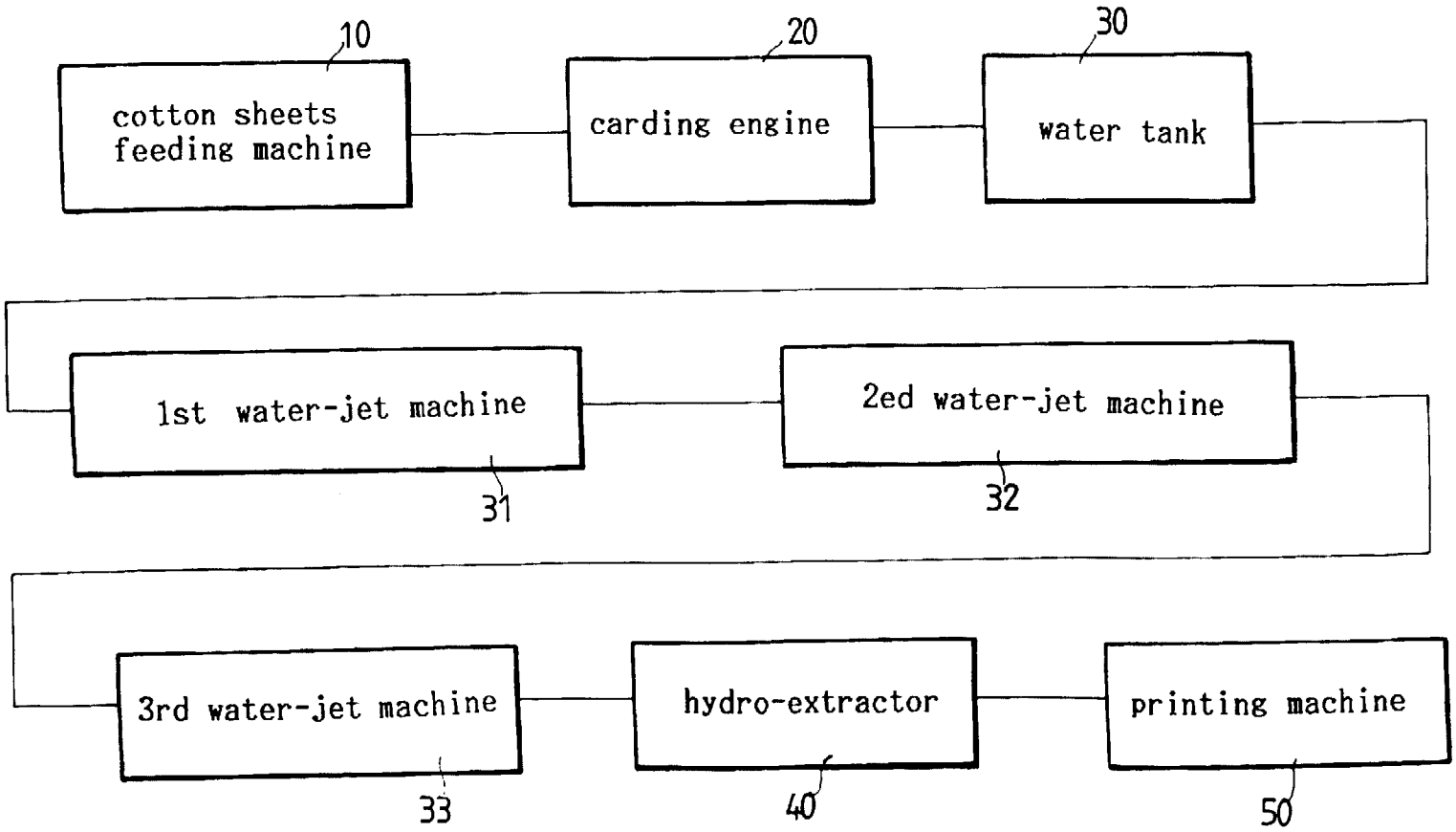
FIG. 1 PRIOR ART
FIG. 1 is a flow chart of processes for manufacturing non-woven fabric.
Figure 2:
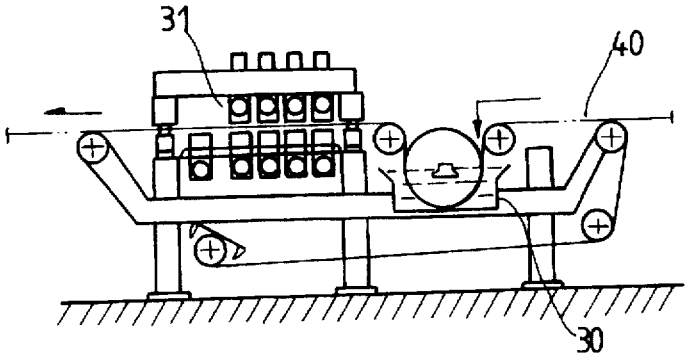
FIG. 2 PRIOR ART
FIG. 2 is an illustrative view to show a conventional water-jet machine and a water tank with an immersion roller transversely mounted thereabove.
Figure 3:
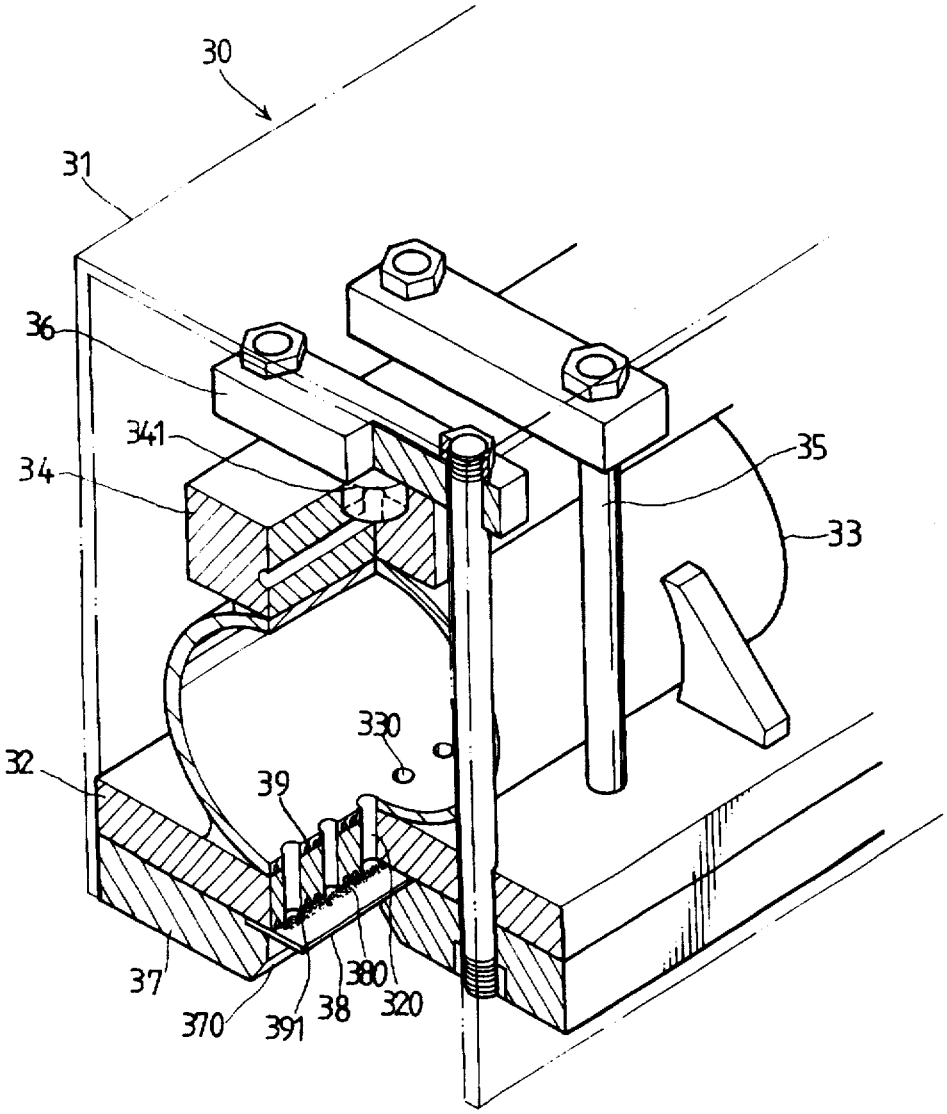
FIG. 3 PRIOR ART
FIG. 3 is a perspective view, partly in section, of a conventional water-jet machine.
Figure 4:
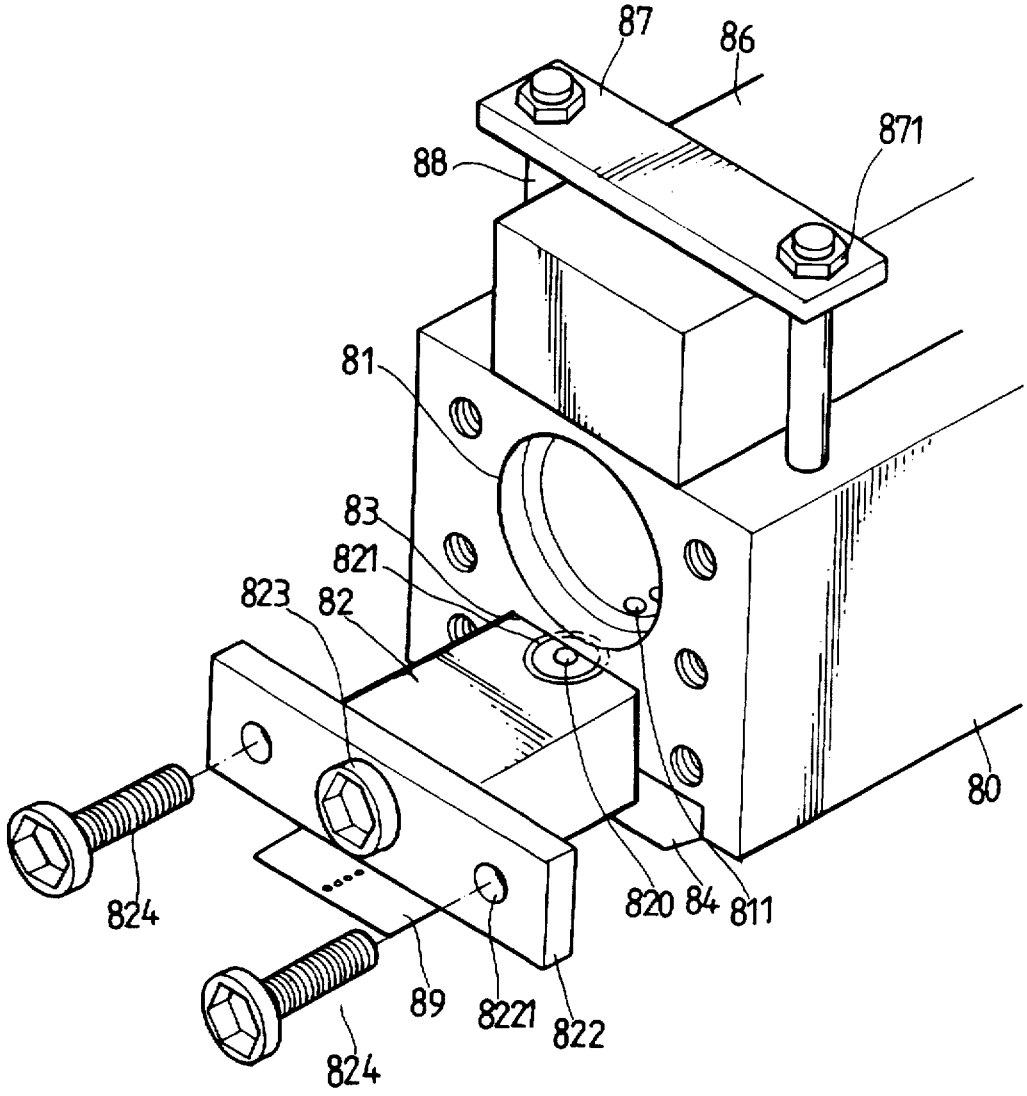
FIG. 4 is a perspective view of a part of a water-jet machine in accordance with the present invention.
Figure 5:
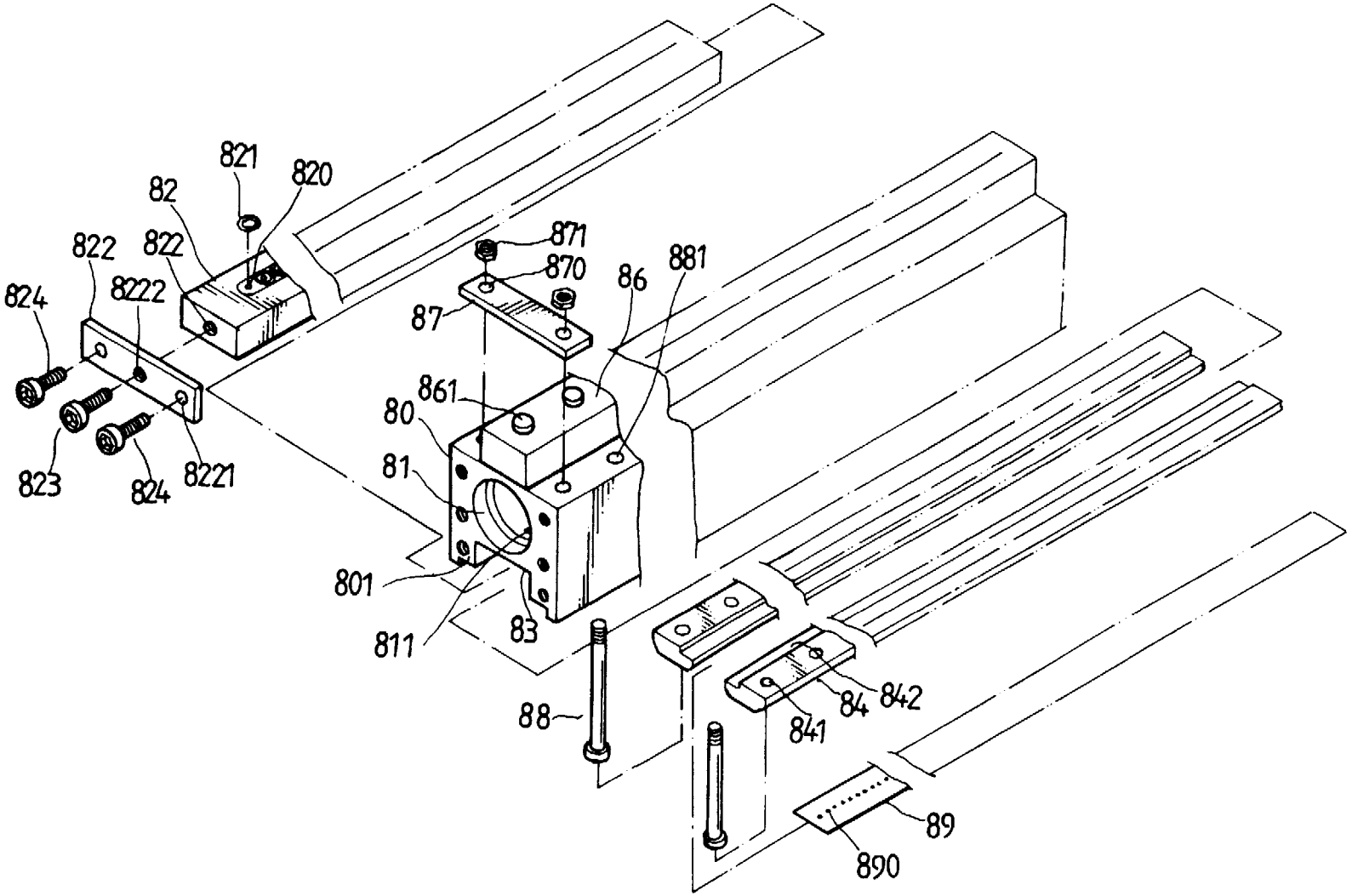
FIG. 5 is an exploded view of the water-jet machine in accordance with the present invention.
Figure 6:
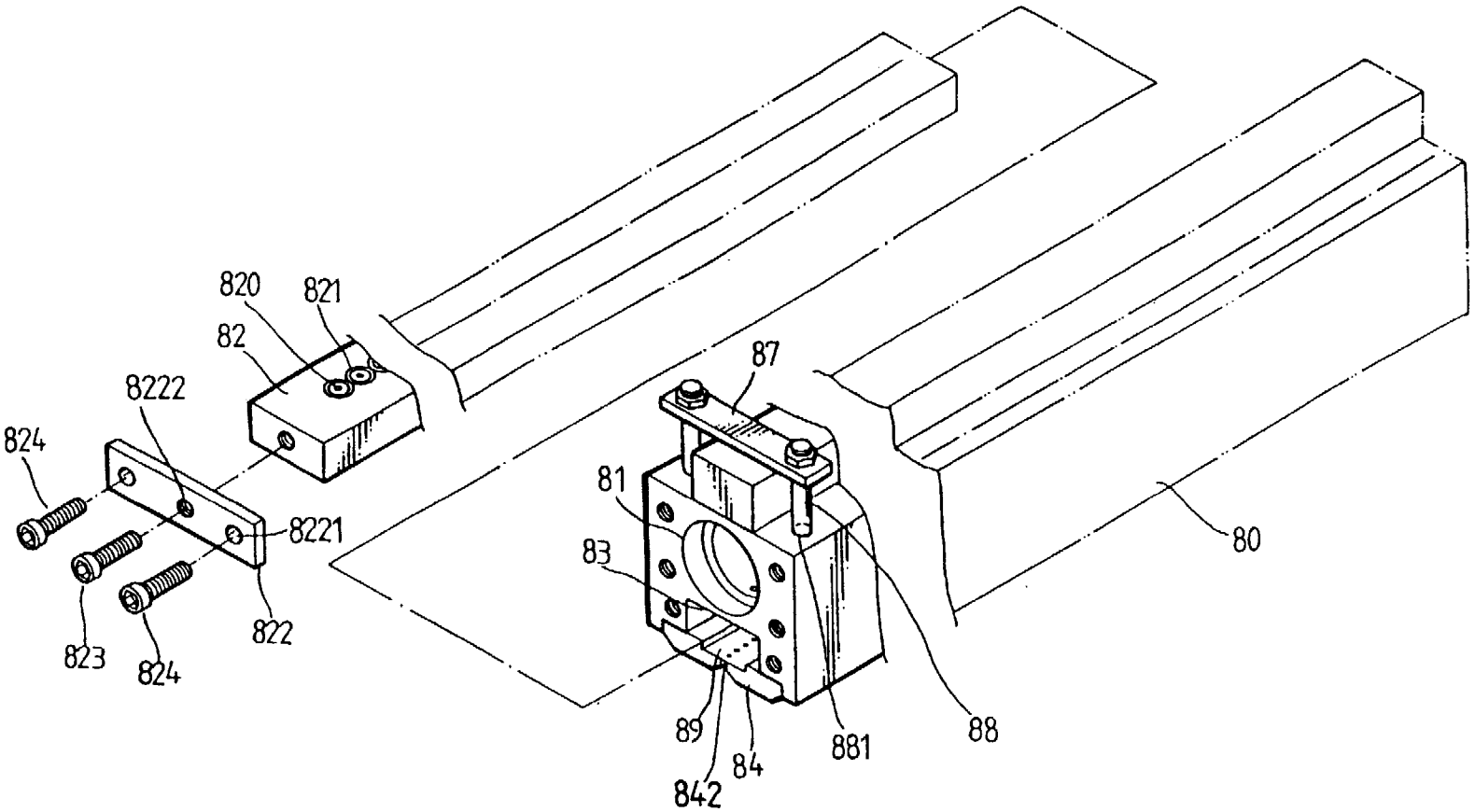
FIG. 6 is a view similar to FIG. 5 wherein only the bar is retracted from the body.

Referring to the FIGS. 4 through 6, a water-jet machine in accordance with the present invention generally includes an elongated body 80 having a ridge 86 extending longitudinally from a top thereof and a plurality of piston means 861 retractably received in the ridge 86 so as to extend upwardly from the ridge 86. The body 80 has a passage 81 defined longitudinally therethrough and a groove 83 defined longitudinally in an underside thereof wherein a plurality of first holes 811 are defined through the underside of the body 80 so that the passage 81 communicates with the groove 83 via the first holes 811. The top of the body 80 has two rows of second holes 881 defined perpendicularly through the body 80 and the two rows of second holes 881 are arranged such that the ridge 86 is located therebetween. At least two first threaded holes 801 are defined in one of two ends of the body 80 such that the groove 83 is located between the two first threaded holes 801.

Two supporting plates 84 each have a plurality of third holes 841 defined perpendicularly therethrough and an elongated recess 842 defined along one of two sides thereof. The two supporting plates 84 are disposed on the underside of the body 80 by extending bolts 88 through the third holes 841, the second holes 881 and fixedly connected to at least one transverse bar 87 which is mounted across over the ridge 86. The transverse bar 87 has at least two holes 870 respectively defined in two ends thereof so that the bolts 88 extend through the two holes 870 and are engaged with nuts 871 so that when the piston means 861 are actuated to extend upwardly from the ridge 86, the transverse bar 87 is lifted to lift the two supporting plates 84 to securely contact the underside of the bar 82 which will be described later. A gap 842 (best seen in FIG. 6) is defined between the two adjacent sides having the respective recesses 842 of the supporting plates 84.

A bar 82 has a plurality of fourth holes 820 defined perpendicularly therethrough and an end plate 822 fixedly connected to one of two ends thereof. The bar 82 has a central threaded hole 822 defined in one of two ends thereof and the end plate 822 has two fifth holes 8221 and a central hole 8222 respectively defined therethrough which is located between the two fifth holes 8221 so that a bolt 823 extends through the central hole 8222 and is threadedly engaged with the central threaded hole 822 to let the end bar 822 be fixedly connected to the bar 82. Another two bolts 824 extend through the two fifth holes 8221 and are threadedly engaged with the respective first threaded holes 801 in the bar 80 so that the bar 82 is received in the groove 83.

A board 89 has a plurality of apertures 890 defined therethrough and is disposed to an underside of the bar 82 wherein the first holes 811, the fourth holes 820 and the apertures 890 communicate with each other and are in alignment with the gap 842 between the two supporting plates 84. A lower portion of the bar 82 and the board 89 are securely received between the two recesses 842 of the two supporting plates 84 when the transverse bar 87 is lifted by the piston means 861. A seal 821 is disposed between each of the fourth holes 820 and the corresponding first hole 811.

Accordingly, the water-jet machine in accordance with the present invention has a simple structure and requires only an easy maintenance especially when the seals 821 are needed to be replaced, the operator (not shown) simply unthreads the nuts 871 to lowered supporting plates 84 and unthreads the bolts 824 to withdraw the bar 82 from the groove 83 to replace the seals 821.

Although the invention has been explained in relation to its preferred embodiment, it is to be understood that many other possible modifications and variations can be made without departing from the spirit and scope of the invention as hereinafter claimed.

What is claimed is:

1. A water-jet machine comprising:

a body having a plurality of piston means retractably received in a top thereof and a passage defined longitudinally therethrough, a groove defined longitudinally in an underside of said body wherein a plurality of first holes are defined through said underside of said body so that said passage communicates with said groove via said first holes, said top of said body having two rows of second holes defined perpendicularly through said body and said two rows of second holes being arranged such that said piston means are located therebetween, at least two first threaded holes being defined in one of two ends of said body and located such that said groove is located between said two first threaded holes;

two supporting plates each having a plurality of third holes defined perpendicularly therethrough and a recess defined along one of two sides thereof, said two supporting plates disposed on said underside of said body by extending bolts through said third holes, said second holes and fixedly connected to at least one transverse bar which is mounted across over said top of said body, a gap being defined between said two adjacent sides having said respective recesses and said transverse bar being lifted by said piston means;

a bar having a plurality of fourth holes defined perpendicularly therethrough and an end plate fixedly connected to one of two ends thereof so that said bar is received in said groove by extending bolts through said end bar and engaged with said first threaded holes of said body, and a board having a plurality of apertures defined therethrough and said board disposed to an underside of said bar wherein said first holes, said fourth holes and said apertures communicate with each other and are in alignment with said gap between said two supporting plates, a lower portion of said bar and said board being securely received between said two recesses of said two supporting plates when said transverse bar is lifted by said piston means.

2. The water-jet machine as claimed in claim 1 wherein said body has a ridge extending longitudinally from said top thereof and said piston means are retractably received in said ridge.

3. The water-jet machine as claimed in claim 1 wherein said bar has a central threaded hole defined in one of two ends thereof and said end plate has two fifth holes and a central hole respectively defined therethrough which is located between said two fifth holes so that a bolt extends through said central hole and is threadedly engaged with said central threaded hole, and another two bolts extending through said two fifth holes and being threadedly engaged with said first threaded holes in said bar.

4. The water-jet machine as claimed in claim 1 wherein said transverse bar has at least two holes respectively defined in two ends thereof so that said bolts extend through said two holes and are engaged with nuts.

5. The water-jet machine as claimed in claim 1 wherein a seal is disposed between each of said fourth holes and said first hole corresponding thereto.

* * * * *